US005536486A

United States Patent [19]

Nagata et al.

[11] Patent Number: 5,536,486

[45] Date of Patent: Jul. 16, 1996

[54] CARBON FIBERS AND NON-WOVEN FABRICS

[75] Inventors: Yoshikazu Nagata; Yoshiyuki Nishimura, both of Ibarakiken, Japan

[73] Assignee: Petoca Ltd., Tokyo, Japan

[21] Appl. No.: 418,890

[22] Filed: Apr. 7, 1995

Related U.S. Application Data

[63] Continuation of Ser. No. 945,406, Sep. 16, 1992, abandoned, which is a continuation-in-part of Ser. No. 493,444, Mar. 14, 1990, abandoned.

[30] Foreign Application Priority Data

Mar. 15, 1989 [JP] Japan ..... 1-60768

[51] Int. Cl.[6] ..... D01F 9/12

[52] U.S. Cl. ..... 423/447.1; 264/29.2

[58] Field of Search ..... 264/29.2; 423/447.1, 423/447.2, 447.3

[56] References Cited

U.S. PATENT DOCUMENTS 4,913,889 4/1990 Takai et al. ..... 423/447.2

FOREIGN PATENT DOCUMENTS 336144 3/1989 European Pat. Off. .

60-181313 9/1985 Japan .

*Primary Examiner*—Michael Lewis

*Assistant Examiner*—Stuart L. Hendrickson

*Attorney, Agent, or Firm*—Armstrong, Westerman, Hattori, McLeland & Naughton

[57] ABSTRACT

The mesophase pitch based and melt blown discontinuous carbon fibers of a peculiar structure are provided. These fibers are characterized in that a large number of small domains, each domain has an average equivalent diameter of from 0.03 μm to 1 μm and has a nearly unidirectional orientation of folded carbon layers, assemble to form a mosaic structure on the cross-section of the said carbon fibers and that the folded carbon layers of each domain are oriented at an angle to the direction of the folded carbon layers of the neighboring domains on the boundary.

1 Claim, 2 Drawing Sheets

CARBON FIBERS AND NON-WOVEN FABRICS

This application is a continuation of application Ser. No. 07/945,406 filed Sep. 16, 1992, now abandoned, which is a continuation-in-part of application Ser. No. 07/493,444, filed Mar. 14, 1990, now abandoned.

BACKGROUND OF THE INVENTION

1. Field of the Invention

This invention relates to high strength carbon fibers and non-woven fabrics containing the said carbon fibers as a principal component thereof. More particularly, it relates to high strength, high modulus discontinuous carbon fibers which are spun from a mesophase pitch by a melt-blowing process and are resistive to forming of cracks and it relates to non-woven fabrics containing the said carbon fibers as a principal component thereof.

2. Summary of the Invention

The mesophase pitch based and melt blown discontinuous carbon fibers of the present invention are characterized in that a large number of small domains assemble to form a mosaic structure on the cross-section of the said carbon fibers, each domain has an average equivalent diameter of from 0.03 μm to 1 μm and has nearly unidirectionally oriented folded carbon layers. Since the orientation direction of the carbon layers suddenly changes on the boundary of the small domains, even when cracks are generated, cracks hardly grow over the boundary. It is an advantage of the present invention that high tensile strength and high fatigue strength carbon fibers can be attained.

The carbon fibers of the present invention are produced according to the melt-blowing process and are collected easily in sheet form, they have an advantage of low production cost, and have a superiority in the use for non-woven fabrics.

Prior Arts

The carbon fibers are showing rapid development as raw materials for aircraft, space satellites, racing cars etc. However, it is said that carbon fibers are too expensive materials to be used in wide varieties of application fields. In order to solve this problem, research toward the adoption of lower cost pitch as a raw material have been advanced.

Research of the fiber-making from pitch has been carried out for a long time, but research works of continuous fibers using a mesophase pitch which is easy in holding orientation of carbon layers at the time of carbonization is recently advanced. As disclosed in Japanese laid open patent application 1974-19127, mesophase pitch is an easily carbonizable material and shows superior properties as a raw material for high strength and high modulus of elasticity carbon fibers.

Since the mesophase pitch is the liquid crystal having a three-dimensional extremely anisotropic property, it shows a peculiar orientation behavior during the melt spinning which is not observable in the case of conventional high molecular substances. J. B. Barr et al reported in Applied Polymer Symposia 29 p. 161–173 (1976) that the structure of the mesophase pitch based carbon fibers changes with the orientation of the carbon layers and that the structure is classified into radial type, onion-skin type and random type.

By the progress of research on the spinning of the mesophase pitch, it has become clear that a radial type structure is generally liable to be taken but the radial type is easy to form cracks on the surface of the fibers compared with other types, and is weak to the repeated mechanical deformation.

As a process for solving such a problem, Japanese laid open patent application No. 1982-154416 discloses a process for producing continuous fibers having random type or onion skin type structure which comprises the use of a high temperature gas stream at the time of centrifugal spinning, but this temperature is lower than a spinning temperature.

Japanese laid open patent application No. 1984-53717 states that in the melt spinning of continuous fibers, random type or onion-skin type appears when a spinning temperature is on the higher temperature side than a bent point which is observed in the relation chart between the logarithm of viscosity of pitch and the logarithm of absolute spinning temperature, and radial type appears when it is on the lower temperature side than the bent point.

These facts show that when the temperature of pitch at the time of melt spinning is on the higher temperature side, random type or onion skin type can be obtained, but this spinning condition lowers the spinnability of pitch and leads to disturb the stability of spinning.

Since pitches have smaller molecular weights compared with general high molecular materials, even in case of the mesophase pitch which has a relatively large molecular weight among various kinds of pitches, the spinnability of the pitches is different from those of high molecular materials, and is generally considered to be the same with those of vitreous super-cooled liquids. This is due to the fact that the viscosity of the liquid becomes greater comparatively to surface tension. The stable shape of the liquid is a cylindrical form and it is difficult to be cut into globular form. In case of pitches, when a spinning temperature shifts toward a higher temperature side, due to the lowering of viscosity of liquids, a period during which circular cylindrical shape is unstable becomes longer, constricted parts and breaks become liable to occur on the liquid cylinder and spinning becomes unstable and further, fluctuation of fiber diameter becomes extremely larger.

In order to solve the problem of liability of forming split flaws on the surface of radial type fibers, Japanese laid open patent application No. 1984-163424 discloses a process for melt-spinning mesophase pitch from spinning holes having an irregular cross-section. This process has effectiveness of providing higher strength and higher modulus of elasticity after carbonization, because during the time of coagulation, the shape of the spun pitch changes from irregular to nearly circular by the surface tension of the pitch and at the same time, the orientation of molecule of carbon precursor turns to random. This process is certainly a superior process, but in case where the irregularity of spinning holes is low and the cross-sectional shape of resulting fibers is nearly perfect circle, randomization of the orientation of carbon molecules of resulting fibers is insufficient and in case where the irregularity of spinning hole is too great, the production cost of the spinning nozzles and deformation or spoiling of the fibers increases by abrasion in use.

As another process, Japanese laid open patent application No. 1984-163422 discloses a process for melt spinning a mesophase pitch from spinning holes having a larger cross-sectional area of outlet than the narrowest cross-sectional area inside the spinning holes. This seems to utilize the tendency that the radial orientation of liquid crystal generated in the high shearing part is randomized by the enlargement of spinning hole and large stretch magnification after delivery from the spinning holes and further shifts to onion-skin orientation, but there is a problem that the production cost of the spinning nozzles becomes higher.

Further, Japanese laid open patent application No. 1984-168127 discloses a process in which a spinning hole is once enlarged, and then it is narrowed. The production of such a spinning hole is much difficult, such a fabrication as joining of two sheets of spinning nozzles together becomes necessary, which makes the cost extremely higher.

Further, separately from the above-mentioned, Japanese laid open patent application No. 1987-41320 discloses pitch origin carbon fibers having a folded structure (the radius of curature is in the range of 1.5–20 nm) in the cross-section, which shows resistance to expansion of split flaws from the surface and superiority in strength and modulus of elasticity. As a concrete production process of these carbon fibers, a process in which petroleum origin mesophase pitch is subjected to melt-spinning by using a spinning hole having a cross-sectional area magnifying power of 2 times or more and at a spinning temperature of 250° C.–350° C. The problem of this process is a large fluctuation of the diameter of fibers because the large magnifying power of the spinning hole makes the position, at which the liquid leaves the outlet of the spinning holes, unstable.

DESCRIPTION OF THE PREFERRED EMBODIMENT

It is an object of the present invention to provide inexpensive discontinuous mesophase pitch based carbon fibers which are free from such drawbacks as easily forming splits in parallel to the fiber axis to lower the properties such as strength, etc. particularly fatigue resistance.

The discontinuous carbon fibers of the present invention means short fibers of carbon, having generally broad fiber length distribution, which are spun to average fiber length of several mm to several 10 cm and carbonized.

At the time of spinning, a mesophase pitch creates molecular orientation in the direction of movement of the liquid flow and in the radial direction within a spinning hole. This is due to the fact that the velocity gradient generated within the spinning hole causes revolution movement in planes of radial direction. This is also a phenomenon which occurs in case of other high molecular weight liquids, but in case of the mesophase pitch, due to the long relieving time of orientation as a characteristic property of the liquid crystal, this orientation is maintained for a time and gives influence upon the structure of pitch fibers after spinning.

If the radial orientation of pitch molecules is favorable to the property of resulting carbon fibers, there is no particular problem. But to orient carbon molecules radially means that the structurally weakest points are arranged in the radial direction. A graphite crystal has a face having no covalent bond in one direction, and radially oriented pitch fibers have this face in the radial direction. This means that resulting carbon fibers are easily torn when they undergo a tensile stress in the circumference. Further, this face is a surface where carbon materials are intercalated by another kind of molecule and is unstable chemically.

In order to produce high strength, high modulus of elasticity carbon fibers from a mesophase pitch, it is necessary to produce pitch fibers having a structure which does not expose such a weak point of carbon molecule, but arts which disclose to control the structure of mesophase pitch based discontinuous carbon fibers have not been known.

The mesophase pitch based and melt blown discontinuous carbon fibers of the present invention are characterized in that a large number of small domains assemble to form a mosaic structure on the cross-section of the said carbon fibers, each domain has an average equivalent diameter of from 0.03 μm to 1 μm and has nearly unidirectionally oriented folded carbon layers and that the folded carbon layers of each domain are oriented at an angle to the direction of the folded carbon layers of the neighboring domains on the boundary.

Figure 1:
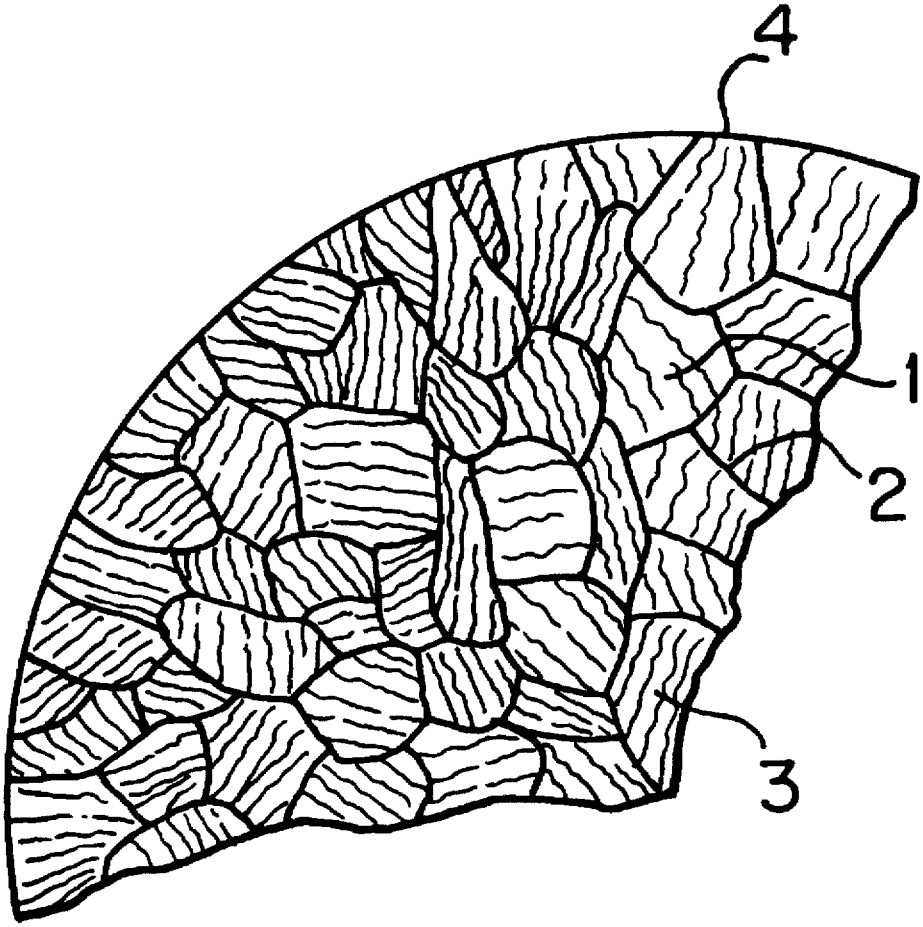
FIG. 1 is a schematic drawing for illustrating mosaic structure which is a characteristic feature of the orientation structure observed on the cross-section of the carbon fibers of the present invention.

In the drawing, 1 is a small domain, 2 is a provisional boundary line, 3 is a folded carbon layer and 4 is the outer surface of a fiber.

The small domain of the present invention means an area in which a certain number of carbon layers are nearly unidirectionally oriented as schematically shown in FIG. 1. If boundary lines are drawn provisionally between neighboring small domains, a few domains are substantially circular shape and many domains are elliptical or polygonal shape. For the indication of the size of non-circular domains in such cases, "an equivalent diameter" (4× cross-sectional area/length of circumference) is generally used to represent a diameter of a domain. The equivalent diameter corresponds to a diameter of a hypothetical circle which would have the same cross-sectional area as a non-circular domain.

The average equivalent diameter of the small domains is preferably 0.07 μm–0.7 μm. There is a problem that when the diameter is too small, the growth of the graphite crystal is poor and effectiveness as domains becomes smaller and when diameter is too large, split flaws are liable to appear on the surface.

The orientation of carbon layers on the cross-section of fibers can be observed through minute examination using polarization from transverse direction. It can be also observed through the distribution of reflective indices of a thin flake of the fiber.

However, since carbon fibers have poor transparency to light, there is a limit for the application of this method. In case of carbon fibers, the cross-section of fibers is made into a thin flake shape, the direction of orientation is assumed by the line appearing along the cleavage of graphite crystal using a transmission electron microscope. It is necessary to make the thickness of the flake less than about 0.5 μm. Since carbon fibers are strong and brittle, its fabrication is extremely difficult. When a thin flake is too thick, the boundary of the domains becomes vague, and measurement of size, shape, etc. becomes difficult. Further, it becomes difficult to observe accurately the direction of orientation.

The carbon fibers of the present invention are characterized in that the carbon layers show a nearly unidirectional orientation within each small domain and that the carbon layers of each domain are oriented at an angle to the direction of the carbon layers of the neighboring domains on the boundary. Further, it is preferable that the small domains have a nearly uniform size in the point that defect parts of strength are not formed. Further, it is preferable that the carbon layers within a small domain are not of perfect planar shape. Particularly those of folded shape having the radius of curvature in the range of 1.5–20 nm such as described in Japanese laid open patent application No. 1987-41320 are preferable, because they are superior in impact resistance.

For the mesophase pitch of the present invention, it is preferable to make the mesophase content larger in order to increase physical properties of carbon fibers such as modulus of elasticity, etc. Usually, a mesophase content of about 70%–100% is preferable.

According to the spinning process of the carbon fibers of the present invention, the mesophase pitch is extruded (for spinning) from spinning holes provided in slits or nozzles from which high speed gas such as an air is spouted out to the surrounding of the extruded pitch. This spinning process is called fundamentally a melt-blowing process, but it is preferable to keep the temperature of spinning nozzles at a temperature of 20° C.–80° C. higher than the softening temperature (measured using a Koka type flow tester) of pitch by external or internal heating and further to set the temperature of the gas higher than that of the spinning nozzle by separatelly controlling from the spinning nozzle temperature. The mesophase pitch is spun to discontinuous pitch fibers. The spouting velocity of the heating gas is preferably more than 100m/sec in order to make spun fibers discontinuous.

The temperature of spun pitch is estimated to be a little lower than the temperature of the spinning nozzle. The spinning viscosity of the mesophase pitch is preferably about 500 poise or greater.

In the conventional melt spinning processes of the mesophase pitch to make continuous fibers, it is considered to be necessary that the spinning viscosity is in the range of from about 10 poise to about 300 poise. Further, it is believed that as the spinning temperature is lowered, i.e. the spinning viscosity is elevated, the radial type orientation is more dominant and the liability to form cracks increases.

In contrast to this, the carbon fibers of the present invention are resistive to forming of cracks in spite of melt blowing at a high spinning viscosity.

The reason why the small domain mosaic structure is attained by a melt blow type spinning of the present invention (though which is carried out at a different condition from conventional processes) is not quite clear. But it is considered that the following is one of the important factors.

As the shearing force in the spinning nozzle is very high because of the high spinning viscosity and as this force is suddenly released at the outlet of the spinning nozzle, disturbance force of orientation is very strong. The movement of the carbon layers is very slow because of the high viscosity.

On the other hand, the temperature of the high velocity spouted heated gas is higher than the temperature of the spinning nozzles and the cooling takes place at a short distance from the outlet of the spinning nozzles by engulfing low temperature surrounding gas.

The spun pitch fibers run without substantial cooling for a while after leaving the nozzle outlets in the heated spouted gas. Therefore, the orientation of the carbon layers created by the shearing force within the spinning nozzle is disturbed complicatedly by the sudden releasing of the shearing force, heat diffusion of the carbon layers, etc.

There is a tendency that a proportion of carbon fibers having large size domains in the cross-section increase with an elevation of a spinning nozzle temperature. Even when a temperature of the spinning nozzle is higher than the softening point of pitch +80° C., a mosaic structure is still observed, but since folding of carbon layers having the radius of curvature of less than 20 nm occurs within the small domains decreases and the inter-layer distance $d_{002}$ after carbonization becomes smaller, flattening of carbon layers advances and the domains become larger and the boundary is liable to be a weak point. This may lower the strength of carbonized fibers in general. Spun pitch fibers are discontinuous and have generally a wide distribution of fiber length of from several mm to several tens of cm on the average. They are preferably collected directly on a porous belt. The pitch fibers are shaped into sheet forms and preferably subjected to conventional infusibilization and carbonization treatment as they are. These fiber sheets can be turned to non-woven fabrics by being subjected to entanglement treatment or adhesion treatment by a suitable process. These non-woven fabrics have a broader fiber length distribution than conventional ones prepared by cutting carbon fiber filaments and, have a tendency of containing large amount of curved fibers among themselves, and have advantages of higher bulkiness, property of keeping warmth and resistivity to fatigue due to repeated deformation.

Function

At the time of spinning, mesophase pitch causes molecular orientation in the direction of movement of the liquid flow and in the radial direction within spinning holes.

This is due to the fact that velocity gradient generated within the spinning holes cause revolution movement in planes of radial direction. This is also a phenomenon which occurs in case of other high molecular weight liquids, but in case of the mesophase pitch, due to the long relieving time of orientation, this orientation is maintained for a time, and gives influence upon the structure of pitch fibers after spinning.

If the radial orientation of pitch molecules is beneficial there is no particular problem, but to orient carbon layers radially means that the structurally weakest points are arranged to radial direction. A graphite crystal has a face having no covalent bond in one direction, and radially oriented pitch fibers have this surface in the radial direction. This fact means that resulting carbon fibers are easily torn when they undergo a tensile stress in their circumference. Further, this face is the surface where carbon materials are intercalated by a different kind of molecule and is chemically unstable.

The present invention is directed to prevent mesophase pitch based carbon fibers from forming weak points by the peculiar structure generated when high viscosity mesophase pitch is extruded at a temperature which is not too much higher than its softening point, drawing the extrudate by the high speed heated gas spouted out from a vicinity of the outlets of the spinning holes to make the spun fibers discontinuous, which gas has a temperature of about the same temperature of the pitch or somewhat higher, thereafter quickly cooling the spun pitch fibers by engulfing low temperature surrounding gas to effect coagulation.

The discontinuous carbon fibers of the present invention are characterized in that a large number of small domains, having a nearly unidirectional orientation of folded carbon layers, assemble to form a mosaic structure on the cross-section of the said carbon fibers. Since the folded carbon layers of each domain are oriented at an angle to the direction of the folded carbon layers of the neighboring domains on the boundary, even when cracks may be formed within the fibers by shock or fatigue, the growth of cracks are prevented at the boundary. On this account, the carbon fibers of the present invention have large tensile strength and large fatigue strength. The discontinous carbon fibers having such a structure have not been reported until now.

When sizes of domains are too large, or distribution of size is too broad, concentration of stresses to the cracks formed in the domains become greater, and reduction of strength is brought about. When sizes of domains are too small, the effect of domains becomes smaller, and since the capacity of preventing the growth of cracks on the boundary of domains is reduced, reduction of strength is brought about.

Since the discontinuous carbon fibers of the present invention have a tendency of being shaped in curved state on account of sudden reduction of drawing power by the gas stream when they leave the spinning nozzles during the melt blowing and further since they have a wide distribution of fiber length, it is easy to obtain bulky materials in the sheet form and non-woven fabrics.

The present invention will be more fully illustrated by specific examples hereinafter which are offered for the purpose of illustration, but not for the limitation of the scope.

EXAMPLE 1

A petroleum based pitch having a softening point of 275° C. (measured using a Koka type flow tester) and a mesophase content of 95%, was melt blown with hollow needle type spinnerets, in which heated air at a temperature of 340° C. spouts out from the surroundings of spinning nozzles having an inside diameter of 0.06 mm, an outside diameter of 2 mm, at a spinning nozzle temperature of 320° C., a spinning viscosity of about 1500 poise, and a heated air spouting velocity of 150 m/sec.

Produced pitch fibers were collected on a net conveyer in the sheet form.

Resulting pitch fibers were subjected to infusibilization according to a conventional process, and subsequently to carbonization treatment at a maximum temperature of 2800° C.

Resulting carbon fibers had a tensile strength of 320 Kgf/mm$^2$, an elongation of 0.43%, a modulus of elasticity of 75,000 Kgf/mm$^2$, a mean fiber length of 87 mm, $d_{002}$ of 3.385 Å and $L_{c(002)}$ of 20.5 Å.

The cross-section of these fibers was observed with a transmission electron microscope by preparing a thin flake having a thickness of about 0.07 μm.

Figure 2:
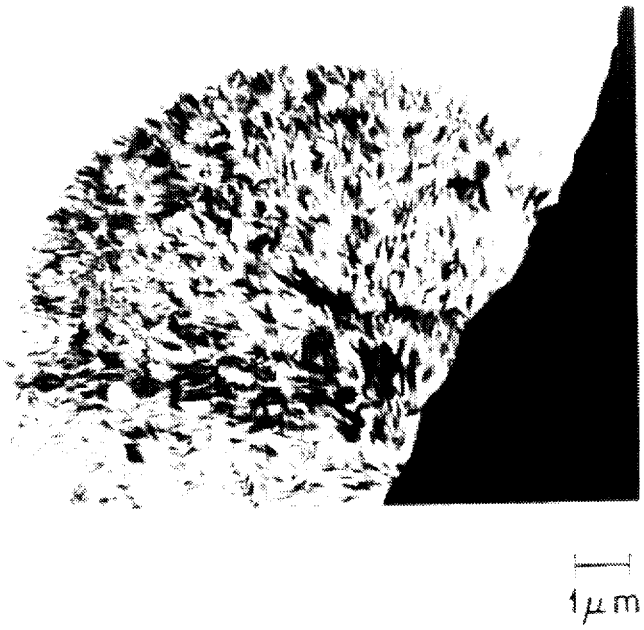
FIG. 2 is a transmission electron-microscopic photograph of a radial type cross-section of the carbon fibers of the present invention.

As shown in FIG. 2, the cross-section has a mosaic structure consisting of a large number of small domains having an average equivalent diameter of about 0.2 μm and having nearly unidirectionally oriented carbon layers. Among the small domains, 25 specimens (on the photograph) are taken at random and a deviation angle of the orientation direction of the carbon layers from the radial direction of the carbon fiber was measured. By setting deviation angle to left as plus, mean and standard deviation were obtained. Mean value was +9.2° and standard deviation was 27.1°. The carbon layers of each domain are oriented at an angle to the direction of the carbon layers of the neighboring domains on the boundary. Further, there were observed a large number of folded carbon layers having the radius of curvature in the range of 1.5–20 nm.

EXAMPLE 2

By using the same pitch and spinning nozzles with those of Example 1, but by changing a spinning temperature, pitch fibers were prepared and after similarly subjecting to infusibilization and carbonization, the cross-sectional structure of the resulting carbon fibers was investigated. The heated air temperature was set to 30° C. higher than the spinning nozzle temperature.

When a spinning nozzle temperature was set to 350° C. (spinning viscosity was about 500 poise), the mosaic structure of the cross-section turned to coarse side and an average equivalent diameter of the domains was 0.9 μm and an average fiber length was 3 mm. The resulting carbon fibers had a tensile strength somewhat lower than that of example 1. When a spinning temperature was further elevated to 370° C., the average equivalent diameter of the domains turned to 1.1 μm.

It is not clear whether due to this coarse structure or other cause, tensile strength of the carbon fiber was considerably inferior to that of Example 1. When a spinning nozzle temperature was set at 300° C., the structure of the cross-section becomes fine mosaic, the equivalent diameter of small domains was 0.05 μm on the average, fiber length was 35 cm on the average. As a tensile strength, a value nearly close to that of Example 1 was obtained.

When the spinning temperature was set at 290° C., the mosaic structure of the cross-section was extremely fine and the boundary of small domains was vague. On this account a tensile strength was inferior to that of Example 1.

EXAMPLE 3

The sheet form material of pitch fibers obtained according to the spinning condition of Example 1, was infusibilized by a conventional process and subjected to a light carbonization at 650° C. Then, it is subjected to needle punching of 120 times/cm$^2$ and further subjected to carbonization at 1400° C. to obtain carbon fiber nonwoven fabrics. Compared with those produced conventionally from carbon fiber filaments by cutting, resulting non-woven fabrics were bulky and superior as materials for keeping warmth and cushion materials.

EXAMPLE 4

A petroleum-based pitch having a softening point of 282° C. (measured using a Koka type flow tester) and a mesophase content of 100% was melt blown with a spinning nozzle, having 0.25 mm diameter spinning holes, provided in the 1.2 mm width slits from which an air stream spouts out, at a spinning nozzle temperature of 320° C. (spinning viscosity of about 2000 poise), the air stream velocity of 200 m/sec and a spinning rate of the pitch of 0.2 g/min. The temperature of the air stream was set to 20° C. higher than the temperature of the spinning nozzle. Resulting pitch fibers were collected on a net conveyer, infusiblized according to a conventional process and subsequently carbonized at a maximum temperature of 2800° C.

By preparing a thin flake having a thickness of about 0.07 μm, the cross-section of the resulting carbon fibers having an average fiber length of 18 cm was observed using a transmission electron microscope.

Figure 3:
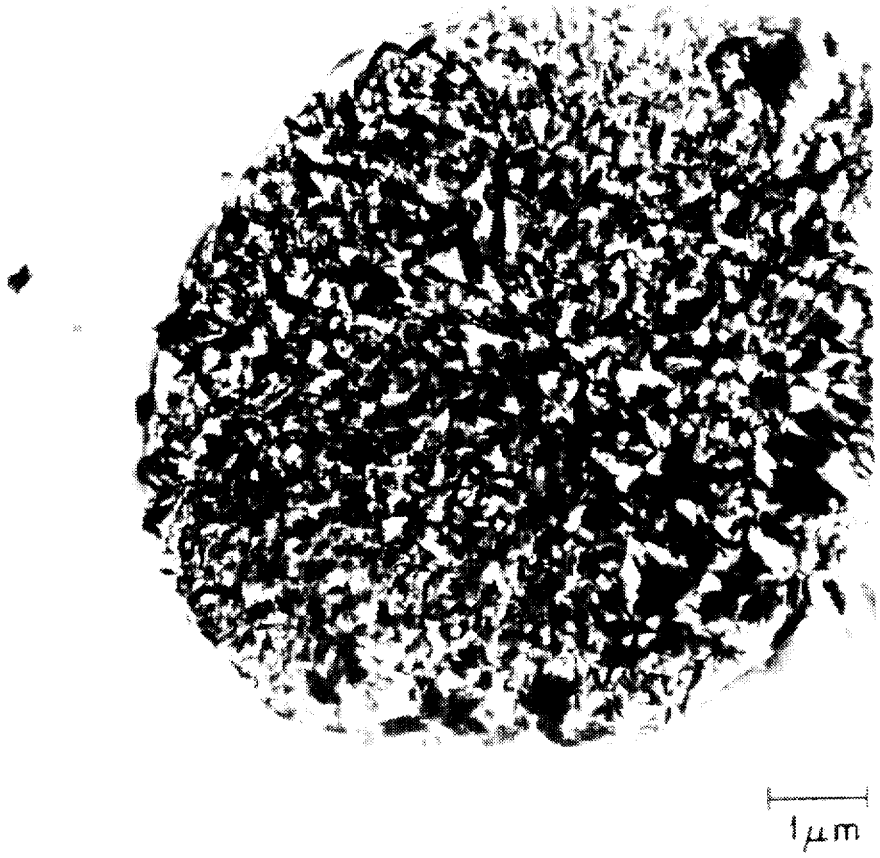
FIG. 3 is a transmission electron-microscopic photograph of a random type cross-section of the carbon fibers of the present invention.

As shown in FIG. 3, the cross-section had a nearly random structure, consisting of small domains of 0.3 μm average equivalent diameter having nearly unidirectionally oriented carbon layers and the carbon layers of each domain are oriented at an angle to the direction of the carbon layers of the nighboring domains on the boundary. Many carbon layers having folds of which the radius of curvature was in the range of 1.5–20 nm were recognized.

EXAMPLE 5

By using the same pitch and the spinning nozzle with those of Example 4 and by changing spinning nozzle temperature, pitch fibers were collected. Resulting pitch fibers were infusibilized according to a conventional process and subsequently subjected to carbonization treatment at a maximum temperature of 2800° C. By preparing a thin flake having a thickness of about 0.07 μm, the cross-section of the resulting carbon fibers were observed using a transmission electron microscope.

When a spinning nozzle temperature was set to 370° C., the average equivalent diameter of small domains was 1.1 μm and a tensile strength was inferior to those of Example 4. When a spinning nozzle temperature was set to 355° C., the structure of the cross-section was a mosaic and the equivalent diameter of small domains was 0.8 μm on the average.

In case of spinning nozzle temperature of 305° C., the average fiber length was long such as 38 cm, but the structure of the cross-section was fine, the equivalent diameter of the small domains was 0.07 μm on the average and showed a tendency of vague boundary.

In case of spinning nozzle temperature of 295° C., because of increased viscosity of the pitch, spinning became extremely unstable.

EXAMPLE 6

A coal-based pitch having a softening temperature of 272° C. and a mesophase content of 78% was melt blown with hollow needle type spinnerets providing spinning nozzles of 0.1 mm inside diameter and 0.25 mm outside diameter and from the surroundings of which nozzles, heated air at a temperature of 340° C. was spouted out. Fibers were prepared at a spinning nozzle temperature of 325° C. and spouting velocity of heated air of 120 m/sec and collected on a net conveyor to form sheet shape.

When resulting pitch fibers were subjected to infusibilization and carbonization under the same condition as in Example 1, carbon fibers having a mosaic structure similar to that of Example 1 were obtained.

Effect of the Invention

The present invention relates to discontinuous carbon fibers which are produced from mesophase pitch through melt-blowing process and which have a high strength and a high modulus of elasticity and thus also resistance to crack forming.

The carbon fibers of the present invention are characterized in that a large number of small domains, each domain has nearly unidirectionally oriented folded carbon layers, assemble to form a mosaic on the cross-section of the carbon fibers. Since the folded carbon layers of each domain are oriented at an angle to the direction of the folded carbon layers of the neighboring domains on the boundary, even when cracks are generated, cracks hardly grow over the boundary. Therefore, it is an advantage of the carbon fibers of the present invention that high tensile strength and high fatigue strength can be attained.

The discontinuous carbon fibers of the present invention are produced according to the melt-blowing process and since their production apparatus is relatively simple, they have an advantage of low production cost. Further, since they are collected easily in sheet form, they are superior in the use for non-woven fabrics.

What is claimed is:

1. A process for producing mesophase pitch based discontinuous carbon fibers of a mosaic structure comprises, melt blowing a mesophase pitch, which has a mesophase content of from about 70% to 100%, with a spinneret provided with spinning nozzles for the pitch with slits or nozzles from which a separately heated gas is spouted out while keeping the spinning viscosity of the mesophase pitch to 500 poise or greater and while keeping the temperature of the heated gas at a temperature higher than the spinning nozzle temperature which is 20° C. to 80° C. higher than the softening temperature of the mesophase pitch.

* * * * *